US008689808B2

(12) United States Patent
Gueret

(10) Patent No.: US 8,689,808 B2
(45) Date of Patent: Apr. 8, 2014

(54) APPLICATOR INCLUDING INORGANIC MATERIAL

(75) Inventor: Jean-Louis H. Gueret, Paris (FR)

(73) Assignee: L'Oreal, Paris (FR)

( * ) Notice: Subject to any disclaimer, the term of this patent is extended or adjusted under 35 U.S.C. 154(b) by 220 days.

(21) Appl. No.: 12/732,726

(22) Filed: Mar. 26, 2010

(65) Prior Publication Data

US 2010/0269842 A1 Oct. 28, 2010

Related U.S. Application Data

(60) Provisional application No. 61/169,813, filed on Apr. 16, 2009.

(30) Foreign Application Priority Data

Mar. 27, 2009 (FR) ..... 09 01469

(51) Int. Cl.
*A45D 40/26* (2006.01)
*A45D 40/24* (2006.01)
*A46B 11/00* (2006.01)

(52) U.S. Cl.
USPC ..... 132/218; 132/318; 132/320; 401/126; 401/127; 401/129

(58) Field of Classification Search
USPC ..... 132/218, 200, 216, 217, 119.1, 317, 132/318, 320; 401/126–130, 182, 118, 119, 401/122, 123, 125, 191, 196, 261, 266, 269, 401/284, 285, 288, 138, 139; 15/104.93, 15/104.94, 167.1, 167.2, 187, 188, 204, 15/207.2; 428/383, 384, 392, 394
See application file for complete search history.

(56) References Cited

U.S. PATENT DOCUMENTS

| | | | | | |
|---|---|---|---|---|---|
| D270,669 | S | * | 9/1983 | Cassai et al. | D28/7 |
| 4,527,575 | A | * | 7/1985 | Vasas | 132/218 |
| 4,744,377 | A | | 5/1988 | Dolan, Jr. | |
| 5,339,483 | A | * | 8/1994 | Byun | 15/184 |
| 5,765,574 | A | * | 6/1998 | Sheffler et al. | 132/218 |
| 5,816,728 | A | | 10/1998 | Nardolillo et al. | |
| 6,059,473 | A | | 5/2000 | Gueret | |
| 6,220,254 | B1 | * | 4/2001 | Gueret | 132/313 |
| 6,309,125 | B1 | * | 10/2001 | Peters | 401/127 |

(Continued)

FOREIGN PATENT DOCUMENTS

| | | |
|---|---|---|
| CN | 1947615 A | 4/2007 |
| CN | 101099616 | 1/2008 |

(Continued)

OTHER PUBLICATIONS

Chinese Office Action for Chinese Application No. 201010139523.6, dated Jul. 29, 2011.

(Continued)

*Primary Examiner* — Vanitha Elgart
(74) *Attorney, Agent, or Firm* — O'Brien Jones, PLLC

(57) ABSTRACT

An applicator may include an applicator member including an inorganic material. The applicator member may include a core that is different from a twisted core, and projecting applicator elements extending from the core. The applicator member may further include a stem supporting the applicator member. The stem may include a rigid portion and a flexible portion extending between the applicator member and the rigid portion.

18 Claims, 7 Drawing Sheets

(56) References Cited

U.S. PATENT DOCUMENTS

| | | | | |
|---|---|---|---|---|
| 6,446,637 | B2 * | 9/2002 | Gueret | 132/218 |
| 6,497,235 | B2 * | 12/2002 | Dorsa et al. | 132/218 |
| 6,691,716 | B2 * | 2/2004 | Neuner et al. | 132/218 |
| 7,083,347 | B2 * | 8/2006 | Marcotte et al. | 401/1 |
| 7,121,284 | B2 | 10/2006 | Gueret | |
| 7,134,799 | B2 * | 11/2006 | Gueret | 401/130 |
| 7,874,300 | B2 * | 1/2011 | Roeder | 132/320 |
| 8,091,562 | B2 * | 1/2012 | Manici et al. | 132/218 |
| 8,210,763 | B2 * | 7/2012 | Gueret | 401/129 |
| 2001/0047808 | A1 * | 12/2001 | Gueret | 132/218 |
| 2002/0011251 | A1 * | 1/2002 | Gueret | 132/218 |
| 2002/0025211 | A1 | 2/2002 | Gueret | |
| 2002/0059942 | A1 * | 5/2002 | Neuner et al. | 132/218 |
| 2003/0015211 | A1 * | 1/2003 | Bouix et al. | 132/218 |
| 2005/0008420 | A1 * | 1/2005 | Gueret | 401/129 |
| 2005/0081874 | A1 * | 4/2005 | Mathiez | 132/218 |
| 2005/0196219 | A1 * | 9/2005 | Habatjou | 401/127 |
| 2005/0249539 | A1 * | 11/2005 | Habatjou | 401/127 |
| 2006/0032512 | A1 * | 2/2006 | Kress et al. | 132/218 |
| 2006/0042647 | A1 * | 3/2006 | Vogel | 132/218 |
| 2006/0054179 | A1 * | 3/2006 | Kuzuu | 132/218 |
| 2006/0272668 | A1 * | 12/2006 | Wyatt et al. | 132/218 |
| 2007/0034224 | A1 * | 2/2007 | Dumler | 132/218 |
| 2007/0079845 | A1 | 4/2007 | Gueret | |
| 2007/0199575 | A1 * | 8/2007 | Del Ponte | 132/320 |
| 2007/0246058 | A1 * | 10/2007 | Bodelin | 132/218 |
| 2008/0011317 | A1 * | 1/2008 | Malvar et al. | 132/218 |
| 2008/0023024 | A1 | 1/2008 | Manici et al. | |
| 2008/0060669 | A1 * | 3/2008 | Malvar et al. | 132/218 |
| 2008/0087296 | A1 | 4/2008 | Gueret | |
| 2008/0115798 | A1 * | 5/2008 | Rainey et al. | 132/218 |
| 2008/0138138 | A1 * | 6/2008 | Gueret | 401/24 |
| 2008/0236608 | A1 * | 10/2008 | Tranchant et al. | 132/218 |
| 2008/0271746 | A1 * | 11/2008 | Gueret | 132/218 |
| 2008/0286030 | A1 * | 11/2008 | Roder | 401/129 |
| 2009/0028627 | A1 | 1/2009 | Gueret | |
| 2009/0052969 | A1 | 2/2009 | Gueret | |
| 2009/0095317 | A1 * | 4/2009 | Poetschl et al. | 132/320 |
| 2009/0114239 | A1 * | 5/2009 | Chen | 132/218 |
| 2009/0194127 | A1 * | 8/2009 | Pires et al. | 132/218 |
| 2009/0214284 | A1 | 8/2009 | Gueret | |
| 2011/0297174 | A1 * | 12/2011 | Ornoski et al. | 132/218 |
| 2011/0297175 | A1 * | 12/2011 | Pires et al. | 132/218 |

FOREIGN PATENT DOCUMENTS

| | | | |
|---|---|---|---|
| EP | 0 038 524 | A2 | 10/1981 |
| EP | 1 306 029 | A1 | 5/2003 |
| EP | 1 920 676 | A1 | 5/2008 |
| EP | 1 935 279 | A1 | 6/2008 |
| FR | 2 904 923 | A1 | 2/2008 |
| WO | WO 2006/090343 | A1 | 8/2006 |

OTHER PUBLICATIONS

French Search Report for FR 0901469, dated Dec. 2, 2009.
English language abstract of EP 0 038 524, dated Oct. 28, 1981.

* cited by examiner

APPLICATOR INCLUDING INORGANIC MATERIAL

This application claims benefit of U.S. Provisional Application No. 61/169,813, filed Apr. 16, 2009. This application also claims benefit of priority under 35 U.S.C. §119 to French Patent Application No. 0901469, filed Mar. 27, 2009.

FIELD OF THE INVENTION

The present invention relates to devices used in the field of cosmetics for applying makeup to the eyelashes and the eyebrows, and more particularly, but not exclusively, to devices including a vibration source that makes it possible to subject an applicator member to vibration during use.

BACKGROUND OF THE INVENTION

Such applicators are already known, in particular from publications WO 2006/09343 and FR 2 904 923 by the Applicant.

EP 1 935 279 discloses an applicator in which the applicator member comprises a core and an external envelop that is free relatively to the core.

Metal applicator members are also known from antique applicators. In practice, metal applicator members have been abandoned in favor of applicators comprising twisted-core brushes or brushes or combs made by injection molding of a thermoplastic material, which are considered to be less aggressive.

BRIEF SUMMARY

In the following description, certain aspects and embodiments of the present invention will become evident. It should be understood that the invention, in its broadest sense, could be practiced without having one or more features of these aspects and embodiments. In other words, these aspects and embodiments are merely exemplary.

At least some exemplary embodiments of the invention provide an applicator. The applicator may comprise an applicator member including an inorganic material (e.g., the applicator member may be made, at least in part, of inorganic material). The applicator member may also include a core that is different from a twisted core (e.g., a core other than a twisted wire core), and projecting applicator elements extending from the core. In particular, the projecting elements may be other than a helical spring. The applicator may further comprise a stem supporting the applicator member. The stem may include a rigid portion and a flexible portion. In particular, the flexible portion may include a synthetic material (e.g., the flexible portion may be made of synthetic material). The flexible portion may extend between the applicator member and the rigid portion.

The term "twisted core" should be understood to mean a core that is formed by two branches of a wire that have been twisted together so as to hold bristles between the turns of the core. Conventional mascara brushes have twisted cores.

The term "inorganic material" should be understood to mean a material other than a polymer having a carbon- or silicone-based chain, in particular other than a thermoplastic material. It may be a material that has a melting temperature that is quite high, e.g. greater than 400° C., that optionally is electrically conductive, and that may be of relative density that is relatively high, e.g. greater than 1, 1.4, 1.5, or 2. It may be a material in the bulk state and not in the form of dispersed filler.

In some exemplary embodiments, the inorganic material may be selected from metals, glasses, minerals, ceramics, in particular alumina-based ceramics, rare earths, or ferrites.

In some exemplary embodiments, the applicator member may be supported directly by the flexible portion.

In some exemplary embodiments, the applicator member may include applicator elements that are formed by ridges of a helical screw thread, in particular of a metal screw. The applicator elements may extend radially or substantially radially from the core.

The presence of the flexible portion imparts more flexibility to the applicator, and makes it possible to compensate, in part, for the rigid character of the applicator member as a result of using said inorganic material, e.g. metal.

The "synthetic material" may be a thermoplastic material.

The invention makes it possible to use novel applicator members made of materials that are hard, such as metal, glass, or ceramic, for example, without their use being perceived as being aggressive by the user, in comparison with the flexibility of twisted-core brushes in particular.

The core may optionally be inorganic, and the applicator elements may optionally be made out of inorganic material, e.g. non-metal or metal. For example, the applicator member may be made entirely out of metal, glass, or ceramic. In a variant, the applicator member includes some portions made of inorganic material, in particular metal, and other portions made of organic material, in particular non-metal. Non-metal applicator elements, e.g. made of thermoplastic material, may be fitted and/or molded on a reinforcement of the applicator member, which reinforcement is made of metal or of any other inorganic material, and may, where appropriate, define applicator elements, in particular metal applicator elements.

The applicator member may be made, at least in part, by molding metal, by machining, by turning, by grinding, by piercing, by laser machining, or by electro-erosion, amongst other manufacturing techniques, depending on the material used.

Specifically, an example of a metal that may be used to make the applicator member is a crude metal, e.g. aluminum or the alloy Zamak®.

Other exemplary embodiments of the invention also provide a device for applying a cosmetic or care product composition. The device may comprise a vibration source, a stem, and an applicator member that extends from the stem and that is subjected to vibration from the vibration source. The applicator member may include a core other than a twisted core. The applicator member may also comprise a metal (e.g., be made, at least in part, of metal). The core may include applicator elements other than a helical spring.

The additional presence of a stem having a flexible portion as defined above, may make it easier for vibration to be adjusted when designing the device, in particular with regard to the transmission of vibration from the stem to the applicator member.

Whether or not there is a vibration source, and whether or not there is a stem having a flexible portion, the projecting applicator element may be in the form of a rib that extends around the core, and that may be interrupted by one or more notches. The rib may be in the shape of a disk, a thread, or a portion of a helical thread.

As a result of the presence of the inorganic material, in particular a metal, the weight of the applicator member may be greater, and the amplitude of the vibration at the distal end of the applicator member may be increased if so desired, in particular by a resonance phenomenon.

Novel possibilities of applying makeup are made available by using an applicator member made of material that is inorganic, and therefore rigid, having mechanical behavior on wiping and on application, in particular when subjected to vibration, that is different from the mechanical behavior of applicator members made of injected thermoplastic material or twisted-core brushes.

In addition, exemplary embodiments of the invention make it possible to perform surface treatments that are impossible to perform with thermoplastic materials, e.g. so as to impart greater sliding or more grip, and a wide range of shapes as possible, in particular as a function of the manufacturing techniques used. Thus, amongst other manufacturing techniques, as mentioned above, turning or laser attack may be used to give the applicator member the desired shape.

Exemplary embodiments of the invention also offer the possibility, if so desired, of benefiting from novel physicochemical interactions between the composition for application and the applicator member, e.g. so as to profit from possible biocidal action of a metal used to make the applicator member, at least in part, from possible magnetization, in particular while using ferrites or rare earths, or from capacity to free ions, e.g. fluorine or calcium, amongst other effects.

Exemplary embodiments of the invention also offer novel possibilities in terms of appearance, e.g. by making applicator members that are covered with a noble metal, e.g. gold, silver, or tungsten. The inorganic material may also be coated with a synthetic material, e.g. polytetrafluoroethylene (PTFE), so as to improve sliding in particular, or so as to modify surface tension.

The applicator member may also be flocked, at least in part, in particular on a portion made out of inorganic material, e.g. metal.

The applicator member may carry at least one bristle or a tuft of bristles, retained on a portion made of inorganic material, in particular metal, of the applicator member, by adhesive, by stapling, or by deforming the portion made of inorganic material, in particular metal, by stamping, when the inorganic material presents ductility that is sufficient. When at least one applicator element is retained by stapling, said stapling may be performed after piercing the material for receiving the staple, in particular when said material is metal. The applicator element(s) may be flattened against a surface of the core before stapling, thereby improving the hold of the staple.

The applicator member may include a through or blind housing that is made in a portion made out of inorganic material, in particular metal, and in which there is received at least one non-metal applicator element, in particular made out of thermoplastic material, that may be snap-fastened or force-fitted in the housing. By way of example, the housing may be in the form of a slot, e.g. elongate along the longitudinal axis of the applicator member. A plurality of applicator elements may be molded as a single part made out of thermoplastic material and fitted in such a slot.

The applicator member may be made as a single part out of metal or out of another inorganic material. In a variant, the applicator member may include applicator elements that are, at least in part, made of metal or of some other inorganic material, and other elements that are not made of metal, in particular being made out of thermoplastic material.

In exemplary embodiments, the stem is rigid, or flexible, or includes a rigid portion and a flexible portion, with the presence of a flexible portion possibly contributing to increasing the amplitude of the vibration of the applicator member and/or to improving comfort in application.

The flexible portion may be made out of a material that is elastically deformable, e.g. made out of elastomer, in particular a thermoplastic elastomer.

The term "elastically deformable" should be understood to mean that the flexible portion presents a certain amount of shape memory. The expression "elastically deformable" should be understood in a broad sense, and in particular covers the situation in which the flexible portion, after being deformed, returns elastically to a position that is not rigorously identical to its initial position, given the kind of material used to make the flexible portion and the shape of said flexible portion, for example. By way of example, the flexible portion may be capable of flexing so as to enable the orientation of the applicator member to be modified through more than 30°, for example.

The term "rigid portion" should be understood to mean a portion that does not deform substantially during application. A rigid portion may be subjected to a small amount of deformation overall when stress is exerted by the fingers on said rigid portion, for example.

The flexibility of the flexible portion may result from its shape and/or from the material(s) used to make it. The flexible portion is situated elsewhere than at the possible wiper member level when the applicator is in place.

The flexible portion may be situated between the rigid portion and the applicator member, preferably in contact with said applicator member.

The flexible portion may be molded in contact with the applicator member, e.g. being molded on the applicator member, in particular on a tang thereof made out of inorganic material, in particular metal. Such a tang may include portions in relief such as notches, for example, improving the fastening of the portion made of inorganic material, in particular metal, on the stem.

The flexible portion of the stem may be fitted on the applicator member, and then the assembly may be mounted on the rigid portion of the stem. In a variant, the flexible portion is molded or mounted on the rigid portion of the stem, and then the stem receives the applicator member. Still in a variant, the flexible portion is molded in contact with the applicator member, and then the assembly is mounted on the stem.

When the flexible portion is molded in contact with the stem, the material used to form the flexible portion may also serve to make at least one portion of the applicator member, e.g. at least one applicator element of the applicator member.

The applicator member portion that is made out of inorganic material, in particular metal, may include a channel enabling the synthetic material to flow, during molding, between the cavity of the mold that is used to manufacture the flexible portion of the stem and the cavity of the mold that is used to make a non-metal portion of the applicator member, e.g. one or more applicator elements made out of synthetic material.

The flexible portion may also be forced-fitted, cold or hot, in or around the rigid portion of the stem, and an applicator member portion that is made out of inorganic material, in particular metal, may also be force-fitted, cold or hot, in or around the stem.

The vibration source may be disposed in the device in such a manner that it produces vibration along the longitudinal axis of the applicator member, and that may turn out to be advantageous while applying makeup. In a variant, the vibration may be transverse, in particular perpendicular to the longitudinal axis of the applicator member.

The device may include a closure element for closing a container containing the composition for application. The cap may constitute the handle of the applicator. By way of example, the applicator may be separate from the container during application.

The closure cap may include means that enable it to be fastened on the container, e.g. a mounting skirt that is threaded, or it may be arranged so as to snap-fasten on the container. In particular, the container may be closed in leak-tight manner. In some exemplary embodiments, the closure cap may receive the vibration source.

As mentioned above, the device includes a stem at a first end of which the applicator member is fastened in optionally separable manner. The stem may include a second end that is fastened to the closure cap of the container containing the composition, or to any other handle.

The vibration source may be masked, in part or almost entirely, by a wall defining a housing that receives it, e.g. being covered over a major fraction of its length by the handle, while it is disposed in the housing. By way of example, in the device, the housing receiving the vibration source is situated at an end of said device, with said housing opening out in a direction opposite from the applicator member, for example.

The orientation of the vibration source relative to the closure cap may be fixed, and the orientation of the closure cap relative to the applicator member may possibly be adjustable.

A longitudinal axis of the vibration source and a longitudinal axis of the closure cap of the container may be parallel.

The device may include a wiper member for wiping the applicator member. The wiper member may be fastened on the container containing the composition, and it may wipe the applicator member while said applicator member is being removed from the container. The wiper member may be rigid or flexible.

The applicator member may pass through the wiper member while the applicator member is being subjected to vibration.

The device may include a switch that enables the user to switch the electric motor on or off. The switch may include a lever that is molded integrally with a support of the motor, in particular with a casing of the vibration source. The device may include any type of electrical switch making contact that is momentary or permanent.

The composition may be a cosmetic, makeup, or care product composition, e.g. mascara.

The applicator member may be made entirely out of metal or some other inorganic material, e.g. it may be machined and/or molded out of metal, or it may be a mixture of metal and synthetic material, in particular with a metal portion and a synthetic portion molded onto the metal portion or fitted thereon. The flexible portion of the stem may be molded onto the metal portion of the applicator member, so that is also forms applicator elements, where appropriate.

One or more applicator elements may be molded out of thermoplastic material through one or more channels made in a portion made of inorganic material, in particular metal, of the applicator member.

The applicator member may include a plurality of transverse ribs, e.g. annular ribs, constituting applicator elements.

The applicator member may have a longitudinal axis that is curvilinear. By way of example, such an applicator member may be obtained by stamping or by molding.

The applicator member may present two application faces that are different, e.g. because of the lengths of the applicator elements on each of the faces and/or because of their spacings, or because metal is used for the applicator elements of one of the faces and synthetic material is used for the other. The two faces may be situated opposite from each other, for example.

The longitudinal axis of the applicator member may coincide with the longitudinal axis of the stem. In a variant, at least one portion of the applicator member is off-center relative to the longitudinal axis of the stem.

The flexible portion may be centered on the longitudinal axis of the rigid portion of the stem, or, in a variant, it may be configured so as to offset the applicator member from the longitudinal axis of the stem.

The applicator member may be axially symmetrical about the longitudinal axis of the core, or it need not be axially symmetrical about said axis.

Some examples may include a packaging and applicator device. The packaging and applicator device may include a container configured to contain a cosmetic composition for application to eyelashes and/or eyebrows and an applicator as described herein.

Some examples may also include a cosmetic treatment method. In the method, a cosmetic composition may be applied to eyelashes or eyebrows using an applicator as described herein.

Aside from the structural and procedural arrangements set forth above, the invention could include a number of other arrangements such as those explained hereinafter. It is to be understood that both the foregoing description and the following description are exemplary only.

BRIEF DESCRIPTION OF THE DRAWINGS

The accompanying drawings are incorporated in and constitute a part of this specification. The drawings illustrate exemplary embodiments and, together with the description, serve to explain some principles of the invention. In the drawings.

MORE DETAILED DESCRIPTION

Figure 1:
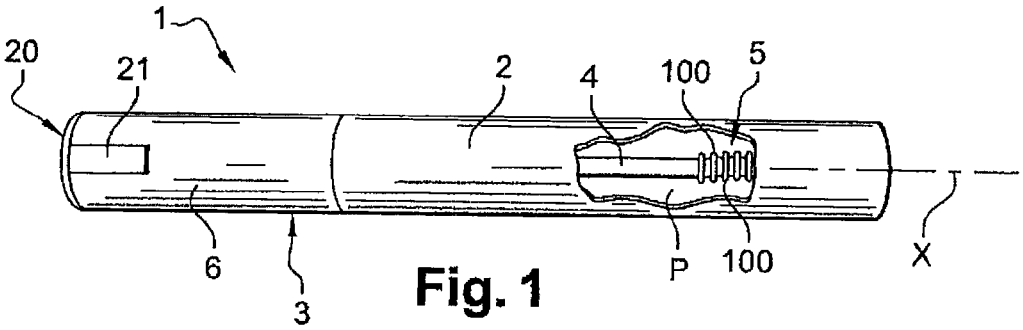
FIG. 1 shows an example of a packaging and applicator device of the invention.
Figure 2:
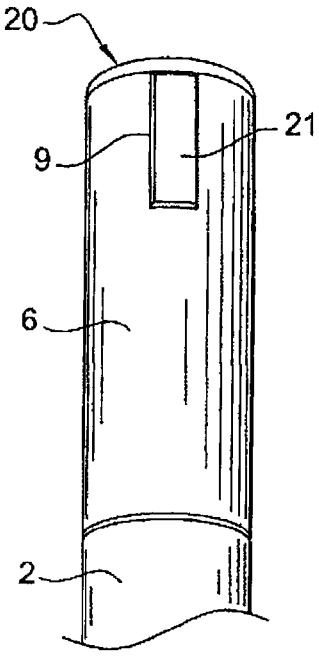
FIG. 2 shows a detail of the FIG. 1 device.
Figure 3:
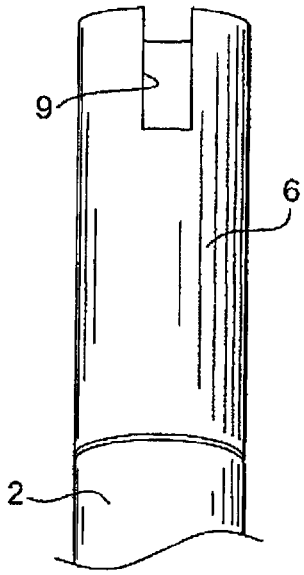
FIG. 3 shows the closure cap with the vibration source removed.
Figure 4:
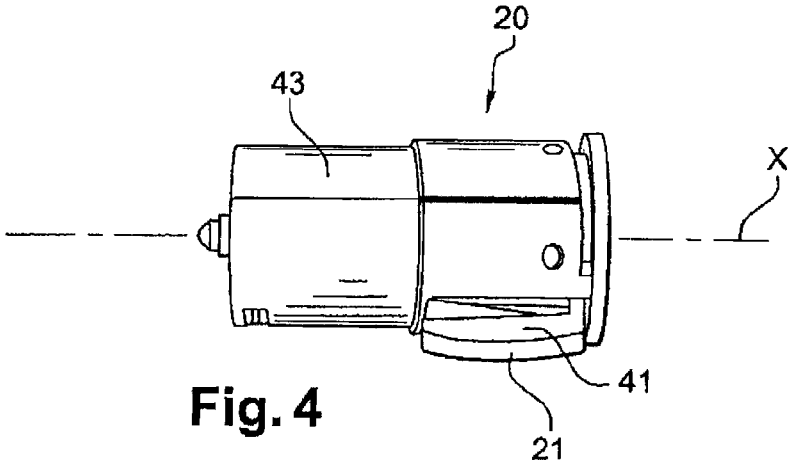
FIG. 4 shows the vibration source of the FIG. 1 device in isolation.

Reference will now be made in detail to a few exemplary embodiments of the invention. Wherever possible, the same reference numbers are used in the drawings and the description to refer to the same or like parts.

An applicator according to exemplary embodiments of the invention may advantageously include a vibration source. However, in some exemplary embodiments of the invention, the applicator need not necessarily include a vibration source.

Vibration Source

When present, the vibration source may be configured so as to generate vibration, e.g. sinusoidal vibration, e.g. of frequency lying in the range 0.5 hertz (Hz) to 1000 Hz, or even in the range 1 Hz to 500 Hz, better in the range 10 Hz to 300 Hz, e.g. in the range 50 Hz to 200 Hz.

The frequency may vary as a function of location or of the pressure with which vibration is transmitted. Vibration may be produced intermittently or continuously. The frequency may be selected as a function of the stiffness of the stem or of the flexibility of the applicator member, so as to enable the applicator member to oscillate resonantly.

The vibration source may include a vibration generator comprising a motor, e.g. a disk-shaped motor, driving a fly-weight in rotation, in particular an off-center fly-weight. The speed of rotation of the motor may lie in the range 2000 revolutions per minute (rpm) to 15000 rpm, e.g. lying in the range 4500 rpm to 10000 rpm.

The vibration generator may be of some other kind, e.g. piezoelectric, electromechanical, or eccentric. The vibration generator may also comprise a motor that rotates a toothed wheel in contact with an elastically-deformable blade like a rattle.

The voltage used may lie in the range 1.5 volts (V) to 9 V, for example. The vibration source may include an electricity source, such as a 1.5 V button battery. The device may also be mains powered via a suitable adaptor.

The use of a button battery may be advantageous for making the device more compact. When using a button battery and a disk-shaped motor, the battery and the motor may be face-to-face, side-by-side, or the face of one may face the edge of the other.

The vibration source may include a control member for controlling its operation. The control member may be triggered by pressing it. The control member may present momentary contact, the operation of the vibration source ceasing as soon as the control member is released.

The device may be configured so as to enable the vibration source to be actuated automatically when said vibration source is put into place on the applicator. In a variant, actuation of the vibration source may be triggered by the user acting on a switch while said vibration source is in place.

The vibration produced may be oriented substantially parallel to the longitudinal axis of the applicator and/or parallel to the longitudinal axis of the applicator member, when the longitudinal axis of said applicator member is rectilinear.

In another embodiment, the vibration may be oriented substantially perpendicularly to the longitudinal axis of the applicator and/or perpendicularly to the longitudinal axis of the applicator member.

The vibration may include a component that is parallel to the longitudinal axis of the stem.

Where appropriate, the orientation of the vibration may be modified by changing the position of the vibration source. The orientation of the motor relative to the applicator member may be modified when the vibration source is moved.

The vibration source may optionally be removable.

The motor is advantageously disposed in a casing comprising two half-shells, e.g. made of thermoplastic material, which half-shells are interconnected via a film hinge or assembled together in some other way. The vibration source may be held on the applicator by friction, by snap-fastening, by screw-fastening, by locking by means of an additional part, by magnetization, by mechanical fastening using hooks and loops of the Velcro type, or by adhesive, e.g. by means of a repositionable adhesive.

When appropriate, the applicator member may be subjected to the vibration of a vibration source mounted on a finger of the user, as described in publication EP 1 920 676.

Devices

Figure 6A:
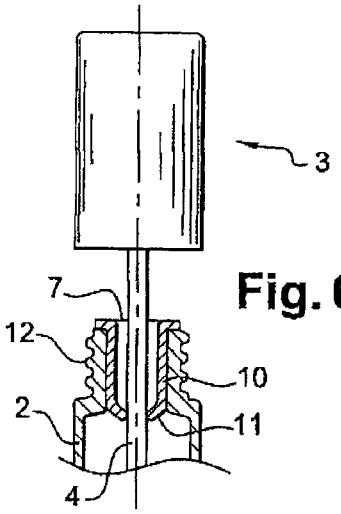
FIG. 6A shows an example of a suitable wiper member.

FIG. 1 shows a first example of a packaging and applicator device 1 made in accordance with the invention. The packaging and applicator device 1 comprises: a container 2 containing a composition P for application; and an applicator 3 that is separable from the container 2 and that comprises a stem 4 that is provided at a distal end with an applicator member 5 of longitudinal axis X, e.g. a rectilinear axis, and that is connected at its proximal end to a handle 6 that also constitutes a closure cap for closing the container 2. The closure cap 6 may be configured to cover an opening 7, as shown in FIG. 6A. The container may be provided with a threaded neck 12.

The container 2 is fitted with a wiper member 10 shown in FIG. 6A, e.g. constituted by a part made of elastomer that is inserted in the neck 12 of the container. The wiper member may optionally be conventional, or it may be adjustable. The wiper lip 11 may define a wiper orifice of circular shape. The handle 6 is arranged so as to close the container 2 in leaktight manner, when it is screw-fastened on the neck, in manner known per se.

Figure 6B:
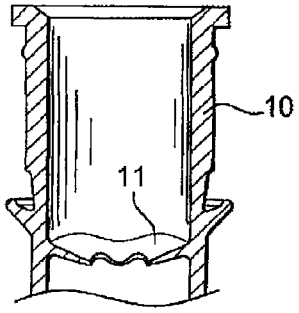
FIGS. 6B and 6C show other examples of suitable wiper members.
Figure 6C:
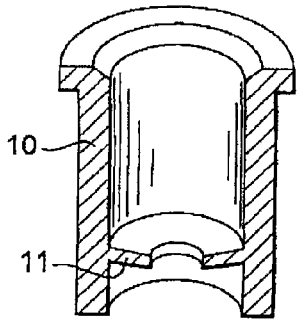

By way of example, the wiper member 10 may be made with a wiper lip of undulating shape, as shown in FIG. 6B, and described in US Published Application No. 2009/0028627, the content of which is incorporated herein by reference, or with a wiper lip that is provided with slots that run tangentially into the wiper orifice, as shown in FIG. 6C, and described in US Published Application No. 2009/0052969, the content of which is incorporated herein by reference. A wiper member may be used that is made of foam or with one or more slots, which slot(s) may be concentric to the wiper orifice, where appropriate.

As shown, the handle 6 may define a housing for receiving a vibration source 20 that is fastened in removable manner to the applicator. In an exemplary embodiment, the handle includes a vibration source that is not removable.

The vibration source 20 includes a control surface 21, e.g. defined by a switch that is triggered by pressing it.

On its side and starting from its proximal end, the handle 6 presents a slot 9 that passes a lever 41 defining the control surface 21.

Figure 5A:
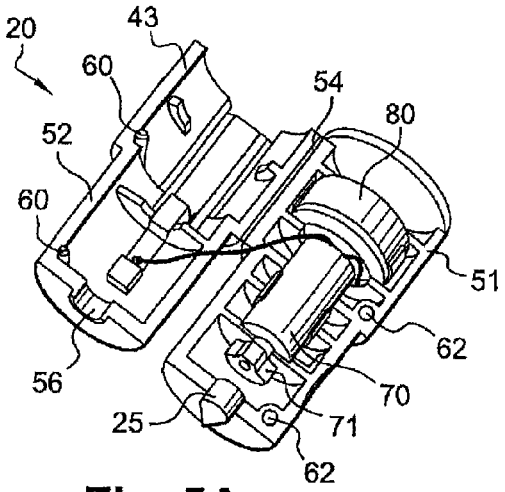
FIGS. 5A and 5B show examples of vibration sources with the casing open.
Figure 5B:
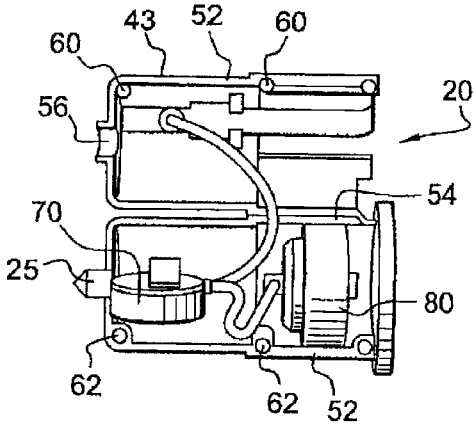

As shown in FIGS. 5A and 5B, the casing 43 of the vibration source 20 may include a finger 25 or any other projection capable of channeling vibration from the vibration source 20 towards the applicator member 5.

The finger 25 may come into contact with the handle 6 in the bottom of the housing receiving the vibration source 20, so as to transmit the vibration to the applicator member.

As can be seen in FIGS. 5A and 5B, the casing 43 of the vibration source 20 may be made with two half-shells 51 and 52 that are interconnected via a film hinge 54, or that are assembled together in some other way, e.g. the two half-shells 51 and 52 being molded as a single piece out of thermoplastic material, or, in a variant, out of another material.

By way of example, the half-shell 51 carries the finger 25, while the other half-shell presents a semi-circular opening 56 that is adapted to engage on the finger 25 when the casing is closed. Assembly pins 60, e.g. two in number, are formed on one of the half-shells, e.g. the half-shell carrying the lever 41, and may engage in corresponding housings 62 of the other half-shell that are situated on the edge remote from the hinge 54, so as to hold the casing 43 in its closed position.

When the casing 43 is closed, the user may press on the control surface 21 so as to make the electrical circuit connecting a battery 80 to a motor 70, thereby starting said motor. In the embodiment in FIG. 5A, the motor 70 rotates a fly-weight 71 having a center of inertia that is not situated on the axis of rotation.

The fly-weight 71 may be external to the motor, or internal to said motor, as in the embodiment in FIG. 5B.

The vibration source may be proposed to the user pre-mounted on the applicator within a package, e.g. a presentation case, a bag, a blister pack, a box. In a variant, the vibration source may be in the non-assembled state together with the applicator or the container within the package. The vibration source may be proposed with at least two different containers or two different applicator members within a single package.

The applicator member 5 includes projecting applicator elements 100 that are, at least in part, metal or made out of another inorganic material, and that are supported by a core 101 that may also be metal or made out of another inorganic material.

The projecting elements 100 may have various shapes, and may be disposed in various ways on the applicator member 5, as described below.

When the applicator includes a vibration source, the stem 4 may be made entirely out of the same material and may be relatively rigid. For example, by holding the handle 6 in one hand, and by pressing on the applicator member with the thumb of the other hand, the stem may be made to flex a little without forming an angle at the junction between the applicator member and the stem.

With or without a vibration source, the stem may advantageously include a rigid portion 4*a* and a flexible portion 4*b*, e.g. made out of different thermoplastic materials. By way of example, the rigid portion 4*a* may be made out of a material that is not an elastomer, while the portion 4*b* is made out of an elastomer.

The flexibility of the flexible portion may be selected as a function of the properties desired for the application, e.g. by means of the choice of material(s) constituting said flexible portion, in particular the Shore hardness(es) of said material (s). The hardnesses of the materials of the flexible portion of the stem and of the adjacent rigid portion of the stem may be different.

The flexible portion 4*b* may be made, at least in part, of a material from the following list: elastomer material; thermoplastic; thermoplastic elastomer; low-density polyethylene (LDPE); polyvinyl chloride (PVC); polyurethane (PU); thermoplastic elastomer polyesters, in particular copolymers of esterified polytetramethylene oxide glycol and butene terephthalate; Hytrel®; Pebax®; Santoprene®; ethylene-propylene-diene terpolymer (EPDM); propylene-diene terpolymer (PDM); ethyl vinyl acetate (EVA); styrene-isoprene-styrene (SIS); styrene-ethylene-butylene-styrene (SEBS); styrene-butadiene-styrene (SBS); latex; silicone rubber; nitrile rubber; butyl rubber; polyurethane; polyether block amide; polyester; this list not being limiting.

The flexible portion 4*b* may be made of a material having hardness that lies in the range 25 on the Shore A scale (ShA) to 80 on the Shore D scale (ShD), for example, or even in the range 40 ShA to 70 ShD.

The total visible length of the flexible portion 4*b* may lie in the range of 10 millimeters (mm) to 35 mm, for example.

A greatest transverse outside dimension of the flexible portion 4*b* may lie in the range 1.5 mm to 10 mm.

The flexibility of the flexible portion 4*b* may vary as a function of the cross-section and of the profile of the flexible portion.

The flexible portion 4*b* may have a solid or hollow cross-section and may be of shape that varies, e.g. of shape selected from the following list: polygonal; square; rectangular; triangular; circular; non-circular; oblong; oval; elliptical; notched; star-shaped; with one or more annular or axial grooves.

The flexible portion 4*b* may be circularly symmetrical about the longitudinal axis of the stem.

The flexible portion 4*b* may present a constriction, where appropriate. The constriction may be of annular shape. Thus, in exemplary embodiments, the flexible portion of the stem is hourglass-shaped or presents an annular groove of crenellated shape.

Alternatively, the flexible portion 4*b* need not be circularly symmetrical. Such a shape makes it possible to obtain flexibility for the stem that varies depending on the direction of inclination of the applicator element relative to its initial configuration.

Regardless of how the stem is made, the flexible portion 4*b* may be configured so that the applicator member can be inclined in reversible manner during application, e.g. by more than 10°, better by more than 15°, better still by more than 30°, or even by more than 45° or 60°, relative to an initial, rest configuration in which the applicator member and the rigid portion of the stem are substantially in alignment, for example.

The rigid portions of the stem may be made of a thermoplastic material, in particular one of the materials selected from the following list: high-density polyethylene (HDPE); LDPE; linear polyethylene (PE); polycrystalline (PT); polypropylene (PP); polyoxymethylene (POM); polyamide (PA); polyethylene terephthalate (PET); and polybutyl terephthalate (PBT); this list not being limiting.

Figure 8:
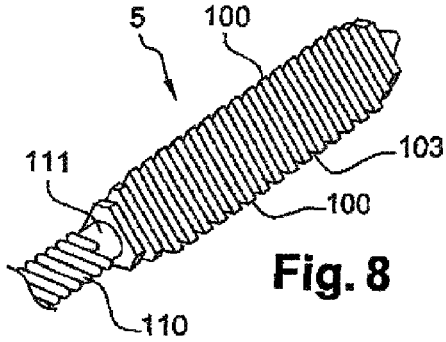
FIG. 8 shows an applicator member of the invention in isolation.

By way of example, the applicator member 5 may be made as a single part out of metal, as shown in FIG. 8, the metal being selected, for example, from: aluminum; aluminum alloys; steel; copper; brass; bronze; titanium; tungsten; iron; or silver; amongst others. The metal may be magnetizable. The applicator member may consist, at least in part, of ferrites or of rare earths, or it may even be constituted entirely of ferrites or of rare earths. The applicator member may be made out of glass or out of ceramic.

The applicator member 5 may be made with an endpiece 110 for fastening on the stem 4, the endpiece 110 possibly including any type of portion in relief 111 adapted for anchoring in the stem 4, possibly in or on the flexible portion 4*b* when said flexible portion exists.

Figure 21:
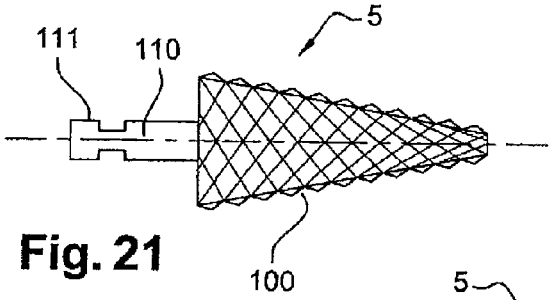
FIGS. 21 to 24 show other examples of applicator members.
Figure 22:
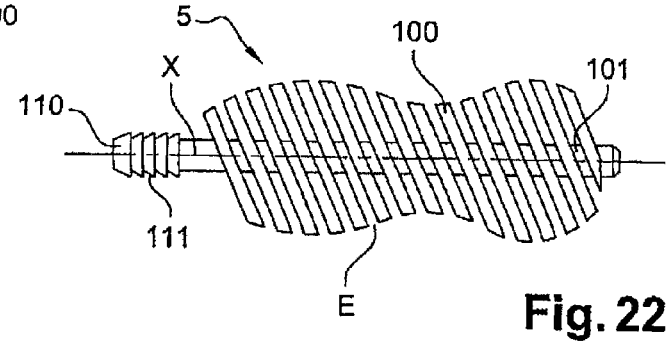

Examples of portions in relief 111 that may be mentioned are a thread, one or more beads, or notches, as shown in particular in FIGS. 21 and 22. In order to create a criss-crossed portion in relief on the applicator member, as shown in FIG. 21, it is possible to form two helical threads that cross in opposite directions, by turning or by some other suitable technique.

The projecting elements 100 may be in the form of ribs that are separated from one another by transverse grooves 103 that extend all around the core 101, for example.

Figure 9A:
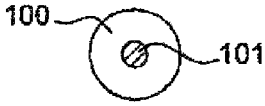
FIGS. 9A to 9L show various examples, amongst others, of sections for the applicator member, showing the outline of the projecting elements.

In an exemplary embodiment, when the projecting elements 100 comprise annular ribs that extend in continuous or interrupted manner around the longitudinal axis of the core, the profile of said elements may vary and need not be limited to the circular shape shown in FIG. 9A.

Figure 9B:
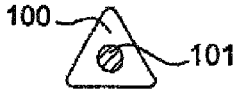
Figure 9C:
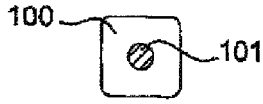
Figure 9D:
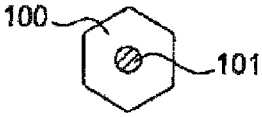

By way of example, the outline of a projecting element 100 may be polygonal, e.g. triangular, as shown in FIG. 9B, square, as shown in FIG. 9C, hexagonal, as shown in FIG. 9D, with the vertices possibly being rounded or pointed.

Figure 9E:
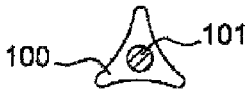
Figure 9F:
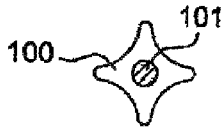
Figure 9G:
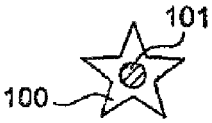

The outline of a projecting element 100 may also be star-shaped, as shown in FIGS. 9E to 9G, e.g. with three branches as in FIG. 9E, four branches as in FIG. 9F, or five branches as in FIG. 9G. The branches may form rows of teeth on the applicator member.

The applicator member may be asymmetrical or off-center.

The sides connecting two adjacent branches may be rounded, e.g. outwardly concave, as shown in FIGS. 9E and 9F, or in the shape of a re-entrant angle, as shown in FIG. 9G.

Figure 9H:
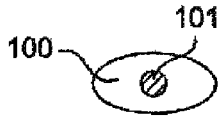

In the example in FIG. 9H, the outline is oval, e.g. of elliptical shape.

Figure 9I:
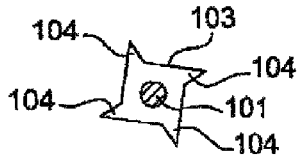

In the example in FIG. 9I, the outline includes sides 103' that are arranged as a polygon, and that are interconnected via points 104. Each side 103' extends to the vertex of its associated point 104. All of the points 104 may be oriented in the same circumferential direction around the core 101.

Figure 9J:
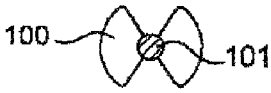

The outline may also present a generally hourglass shape, as shown in FIG. 9J, e.g. with two diametrally opposite wings that may be connected together merely by the core, or that may be connected around the core.

Figure 9K:
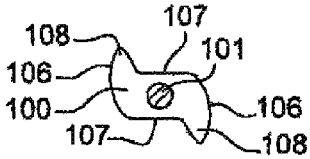

In the example in FIG. 9K, the outline includes rounded portions, in particular circular 106', and rectilinear portions 107 that are connected to the rounded portions forming points 108.

When observed along the longitudinal axis of the core, the outline of a projecting element may generally be axially symmetrical about the longitudinal axis of the core, or alternatively, it need not present axial symmetry about the longitudinal axis of the core.

Figure 9L:
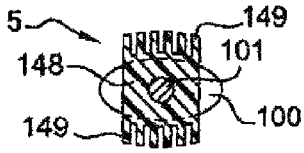

FIG. 9L shows an exemplary embodiment where the applicator member is made with both a portion made of inorganic material, in particular metal, and with a portion made of organic material, in particular thermoplastic material.

By way of example, the metal portion includes applicator elements 100 in the shape of ribs projecting over at least one side of the applicator member, the elements being interconnected via a core 101.

By way of example, the non-metal portion 148 is made out of thermoplastic material and may include applicator elements 149 that may, for example, project beyond the metal portion on at least one side of the applicator member, e.g. on two opposite sides, as shown in FIG. 9L. In this figure, the applicator member presents two opposite sides provided with metal applicator elements 100, and between these two opposite sides, two other opposite sides provided with non-metal applicator elements 149. The non-metal portion 148 may be molded onto the metal portion.

In the examples in FIGS. 9A to 9L, the core 101 is shown with a cross-section that is circular or oval, but this section may also be of polygonal or some other solid or hollow shape. In addition, the projecting elements may be solid or perforated.

When the core and/or the projecting elements are perforated, said perforations may possibly be filled with a non-metal filler material, e.g. a thermoplastic material.

When observed from the side, perpendicularly to the longitudinal axis, the applicator member may present an envelope surface having profiles that are different.

Over at least a fraction of the length of the applicator member, e.g. more than half of its length, the envelope surface that is defined by the free outlines of the projecting elements 100 may be cylindrical, of optionally circular section, the cross-section of the envelope surface possibly being, in particular, one of those described in FIGS. 9A to 9L.

Figure 7:
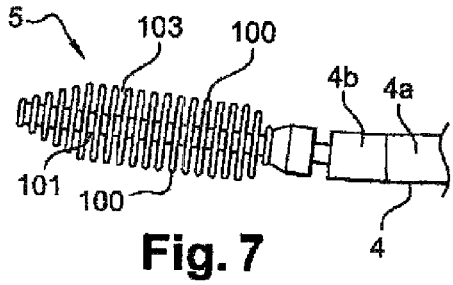
FIG. 7 is a fragmentary side view of an example of an applicator made in accordance with the invention.

The distal portion of the envelope surface may taper towards the distal end of the applicator member, as shown in FIG. 7. The same may apply for the proximal end of the envelope surface, e.g. for the purpose of making it easier to pass through the wiper member, both during insertion into the container and during removal therefrom.

Figure 10:
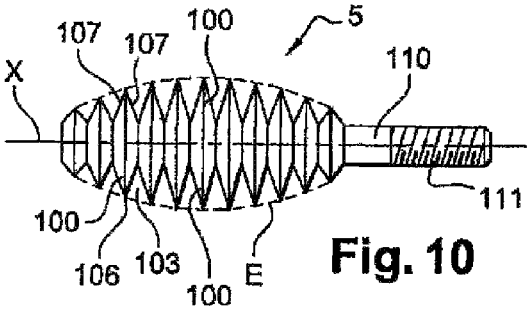
FIG. 10 is a side view showing another example of an applicator member of the invention.

The envelope surface E may pass through an extremum, e.g. a maximum, between the proximal and distal ends of the portion of the applicator member that is used to apply composition, as shown in FIG. 10.

Figure 11:
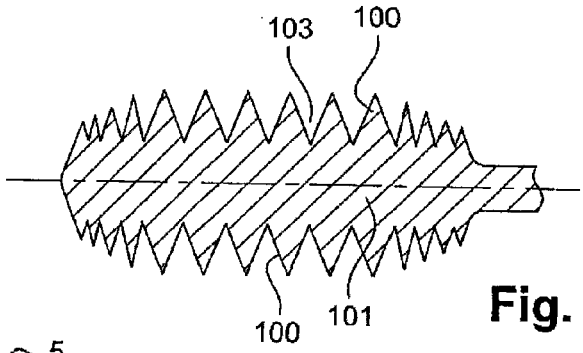
FIG. 11 is a longitudinal section showing another example of an applicator member.

The spacing between the projecting elements 100 need not be constant along the longitudinal axis of the applicator member, as shown in FIG. 11. For example, the spacing may be small in the proximity of the proximal and distal ends of the portion of the applicator member that is used to apply composition, and larger in a middle portion of the applicator member.

FIGS. 10 and 11 show an exemplary embodiment of making the projecting elements with a shape that tapers towards a vertex 106, e.g. with two faces 107 on either side of the vertex 106 that are conical about the longitudinal axis X of the applicator member. Thus, two adjacent faces 107 belonging to two consecutive projecting biconical elements may form an outwardly-diverging V-shaped groove 103.

Naturally, variable spacing may be provided between the projecting elements 100 along the applicator element, with any shape of projecting element.

Figure 12:
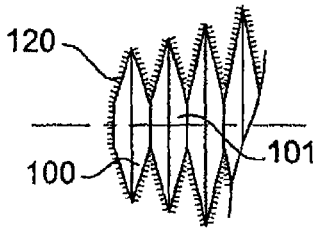
FIG. 12 shows an example of flocking the applicator member.

The projecting elements 100 and/or the core 101 of the applicator element may receive flocking 120, as shown in FIG. 12.

The flocking 120 may comprise a single type of flocking or a mixture of types of flocking.

FIGS. 13 to 17 show various examples of configurations of projecting elements 100, amongst others.

Figure 13:
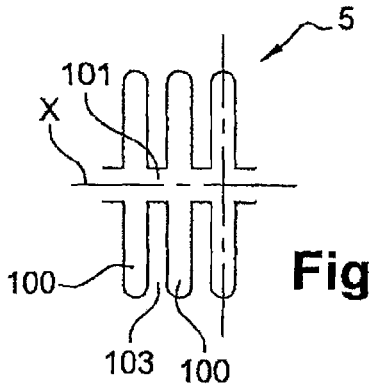
FIGS. 13 to 17 show various configurations of projecting elements.

The projecting elements, whether or not they are made of metal, may have rounded vertices, as shown in FIG. 13, and, by way of example, each may be oriented perpendicularly to the longitudinal axis X, e.g. having a shape that is symmetrical about a mid-plane that is perpendicular the axis X that may be rectilinear or curvilinear.

Figure 14:
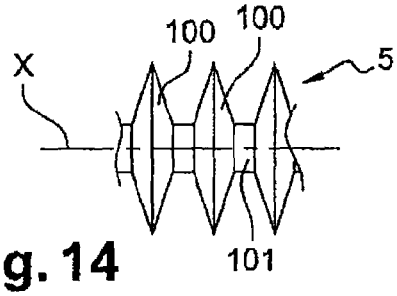

The applicator member 5 may be made with projecting elements that, whether or not they are made of metal, are spaced apart along the core 101, as shown in FIG. 14, or are touching, as shown in FIGS. 10 and 12, for example.

Figure 15:
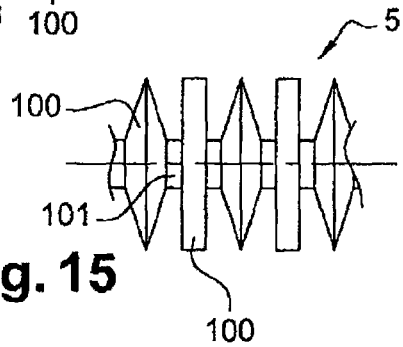
Figure 16:
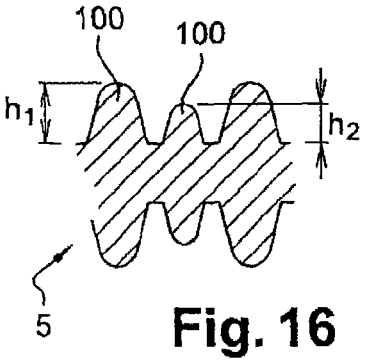
Figure 17:
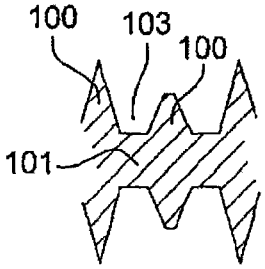
Figure 18:
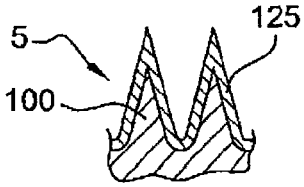
FIG. 18 shows an example of surface treating or of coating the applicator member.

FIGS. 15 to 17 show an exemplary embodiment of the applicator member 5 including projecting elements that, whether or not they are made of metal, are of different shapes, e.g. a succession of projecting elements each of biconical shape alternating with projecting elements each in the shape of a cylinder segment.

When they are of different shapes, the projecting elements may have different heights. For example, projecting elements of different heights $h_1$ and $h_2$ may be present on the applicator member, with taller elements $h_1$ alternating with shorter elements $h_2$, for example.

As shown in FIG. 17, the shorter projecting elements may be made by truncating the vertices of the taller elements, e.g. by machining.

The applicator member 5 may receive a surface treatment or a surface coating, e.g. so as to form, on its surface, a layer 125 of a metal other than the metal out of which the underlying portion of the applicator member is made, e.g. a plating of a noble metal, e.g. gold, silver, or tungsten. The layer 125 may also be formed by heat treating the metal, or it may be constituted by a layer of an oxide, e.g. so as to impart greater sliding or more grip to the applicator member, or so as to modify its color. By way of example, the surface of the applicator member may be made of anodized aluminum.

In some exemplary embodiments, the applicator member may include projecting elements that are surface coated with a varnish and/or with a paint or with a non-metal coating, e.g. elastomer or PTFE.

The applicator member may receive a passivation or anodization treatment. The applicator member may be sand blasted or treated by plasma or eroded in some other way.

The applicator member 5 may be made with any shape that enables it to be fastened on the stem 4.

Figure 19:
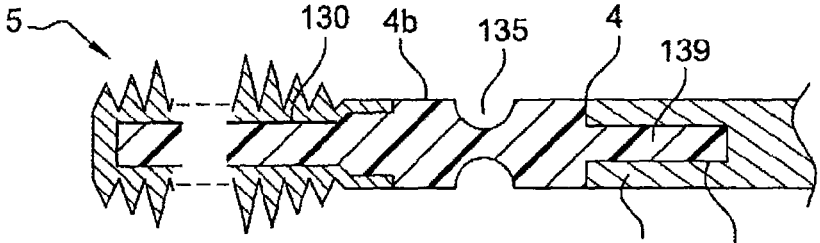
FIGS. 19 and 20 show examples of mounting the applicator member on the stem.

For example, the applicator member 5 may be hollow and may present a cavity 130 into which the material of the flexible portion 4*b* of the stem may be molded, as shown in FIG. 19. By way of example, the cavity 130 may extend over more than the major fraction of the length of the portion of the applicator member 5 that is used for application.

It can be seen in FIG. 19 that the flexible portion 4*b* may be made, where appropriate, with a groove 135 that is situated between the applicator member 5 and the rigid portion 4*a* of the stem. In this figure, it can also be seen that the flexible portion 4*b* may be fastened on the rigid portion 4*a* by inserting an endpiece 139 of the flexible portion 4*b* into a housing 140 of the rigid portion 4*a*.

Figure 20:
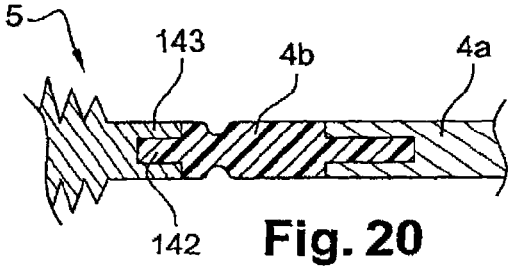

FIG. 20 illustrates the fact that the flexible portion 4*b* may include an endpiece 142 that is inserted in a housing 143 formed at the proximal end of the applicator member 5.

The applicator member 5 may be made with projecting elements 100 that are short, e.g. formed in a criss-cross pattern on the surface of the applicator member.

FIG. 22 shows an exemplary embodiment with projecting elements 100 extending along respective planes that slope relative to the longitudinal axis X of the core 101 of the applicator member 5.

This figure also shows the envelope surface E passing through a minimum between the proximal and distal ends of the application surface, the envelope surface having the general shape of a peanut.

Figure 23:
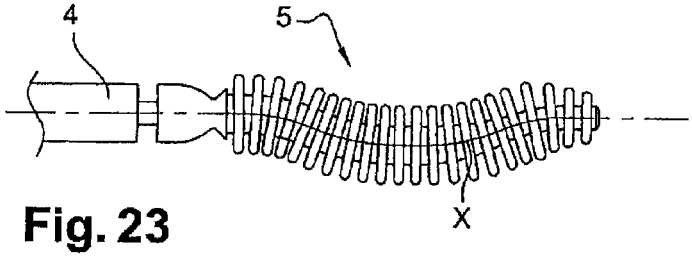

FIG. 23 shows an exemplary embodiment which includes bending the applicator member 5 so as to give the longitudinal axis X of the core a shape that is curvilinear, the longitudinal axis X having, for example, a first curve in one direction, then a second curve in the opposite direction, within the same plane.

The distal end of the applicator member may optionally be situated on the longitudinal axis of the stem 4.

The applicator member 5 may optionally have a portion of core of axis that is rectilinear and parallel to the longitudinal axis of the stem.

Figure 24:
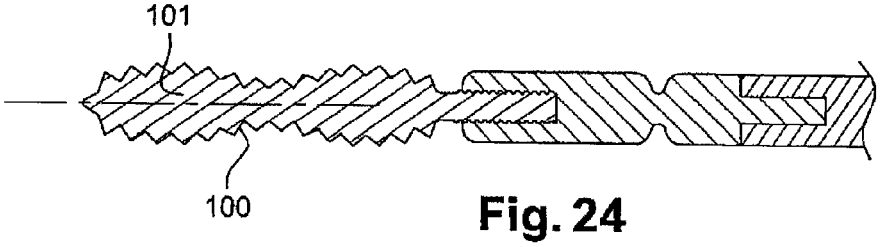

FIG. 24 shows an exemplary embodiment in which the core has a cross-section that varies along the longitudinal axis of the core, e.g. with projecting elements 100 of constant height. Thus, the profile of the envelope surface E may vary as the cross-section of the core changes.

In order to make an applicator member 5, metal may be injected into a mold. After the molding stem, the applicator member may possibly be machined.

It is possible to begin with a bar, in particular a circularly-cylindrical bar, then machine the bar so as to form an endpiece for fastening on the stem, and then machine the disks forming the projecting elements that are used for application. By way of example, machining may be performed by rotating the bar about its own axis, or by rotating a tool around the bar. Where appropriate, it is then possible to impart the desired section to the applicator member, e.g. by milling, in particular a section such as one of those shown in FIGS. 9A to 9L.

Figure 33A:
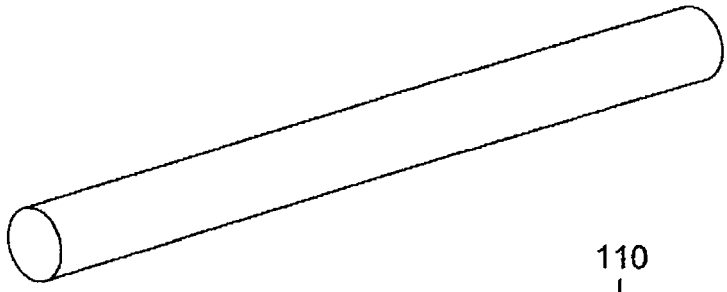
FIGS. 33A to 33E show various steps of making an applicator member of the invention.
Figure 33B:
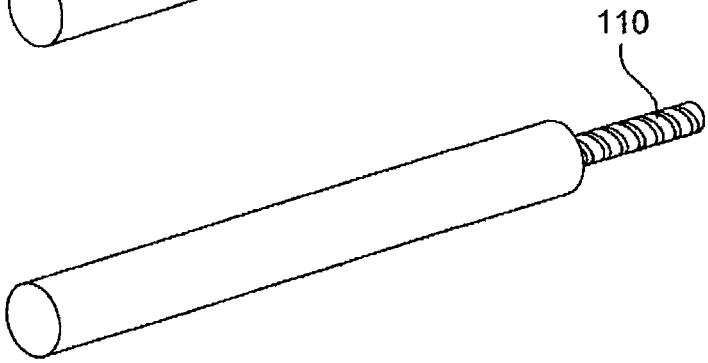
Figure 33C:
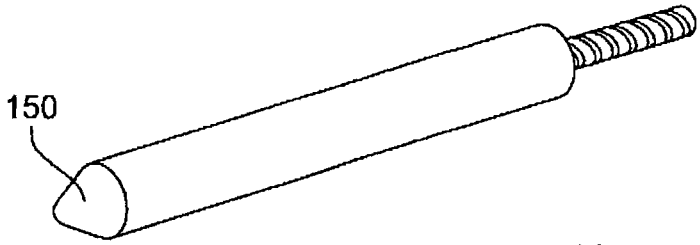

Then, where appropriate, the applicator member may be subjected to surface treatment, e.g. sand blasting or some other treatment. It is also possible to begin with a metal bar, as shown in FIG. 33A, then machine the endpiece 110 for fastening on the stem, as shown in FIG. 33B, then the tip 150 of the applicator member, as shown in FIG. 33C, and then produce portions in relief on the surface of the applicator member, by turning or some other machining technique, e.g. laser attack or chemical etching.

Figure 33D:
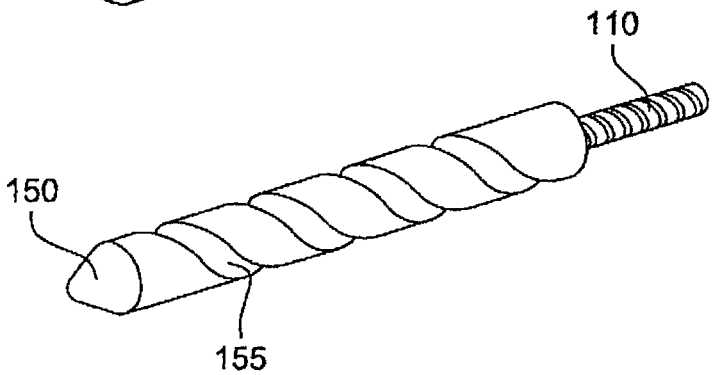
Figure 33E:
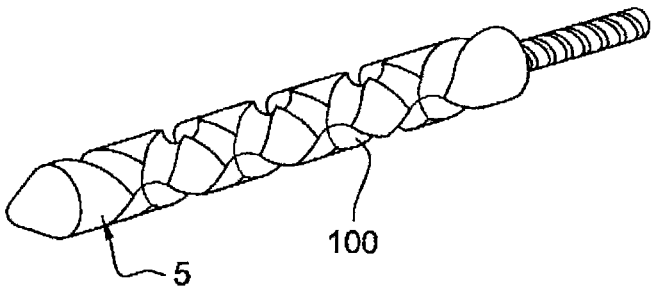

By way of example, and as shown in FIG. 33D, it is possible to produce a helical thread 155 along the applicator member, between the tip 150 and the endpiece 110, then, once the thread has been produced, to turn the projecting elements, as shown in FIG. 33E.

By using a machinable metal, it is possible to make an applicator member with shapes that are novel, and, by way of example, to make a plurality of portions in relief successively along the applicator member, so as to combine all shapes of ribs and grooves.

In general, the height of the projecting elements, whether or not they are made of metal, measured relative to the core, may optionally be constant for a single projecting element, on going around the longitudinal axis of the core, and the mean height may vary in the range 0.5 mm to 5 mm, for example.

By way of example, the thickness of a projecting element 100, measured parallel to the longitudinal axis of the core, may lie in the range 0.2 mm to 1 mm, e.g. in the range 0.5 mm to 0.6 mm, in particular 0.55 mm. For example, the thickness of the ribs used as applicator elements, in particular when they are in the form of disks, may be at least 0.2 mm, and the grooves that are formed between two adjacent ribs may be of thickness lying in the range 0.5 mm to 3 mm. The base of a rib, at the connection with the core, may have a thickness of up to 3 mm, for example.

By way of example, the number of projecting elements on the applicator member lies in the range 3 to 600, e.g. 3 to 40.

For example, an applicator member having a 20 mm long portion that comes into contact with the eyelashes for application, may include 25 applicator elements constituted by ridges of a thread, and for a 35 mm long portion, there may be 40 to 45 applicator elements.

By way of example, the weight of the applicator member is greater than 0.5 grams (g), e.g. lying in the range 0.7 g to 3.5 g.

Where appropriate, the applicator member may be made not only with projecting elements that are made of metal, at least in part, but also with projecting elements that are not made of metal, e.g. made by molding a thermoplastic material onto the applicator member. That makes it possible, on the applicator member, to benefit from a plurality of zones having characteristics that differ in terms of loading a composition and/or combing and applying the composition.

In order to make the applicator member, at least in part, it is possible to use a thermoplastic material including a filler of metal particles, so as to increase the density of the projecting elements that are not made entirely out of metal. The proportion by weight of metal particles may lie in the range 0.5% to 70%.

The projecting elements may be made by connecting metal disks to a core that may optionally be made of metal.

On any of the examples of applicator members shown in the drawings, it is possible to make one or more additional longitudinal grooves parallel to the longitudinal axis of the core, thereby forming additional notches on the applicator member. The invention is not limited to the embodiments described. In particular, the characteristics of the embodiments shown may be combined together within embodiments that are not shown. For example, any of the applicator members may be provided with any of the fastener means shown in the drawings, for fastening the applicator member on the stem.

The stem may be made with or without a flexible portion 4*b* for any of the applicator members shown in the drawings.

The envelope surface may have a greatest diameter that is optionally greater than the diameter of the stem.

The applicator member may possibly be stamped so as to form an angle at its base.

The applicator member may have projecting elements formed by one or more helical threads.

In some exemplary embodiments, when the applicator member includes a helical thread, the thread may progress in both the clockwise and the counter-clockwise directions towards the distal end. Where appropriate, the applicator member may include a thread that progresses in the clockwise direction and then in the counter-clockwise direction or vice versa.

Figure 25:
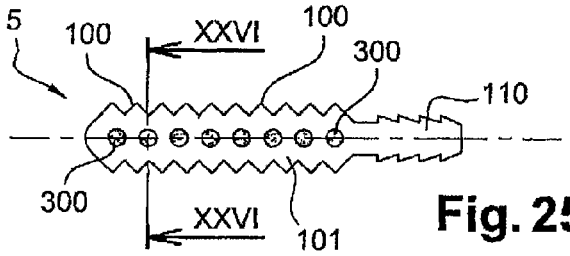
FIGS. 25 and 27 show two variants of applicator members in isolation.

FIG. 25 shows an exemplary embodiment of the applicator member including a metal portion on which tufts of bristles 300 are fitted.

By way of example, the applicator member 5 includes holes 301 into which the tufts of bristles 300 are inserted, the bristles being retained on the metal portion, e.g. by stamping said metal portion.

Figure 26:
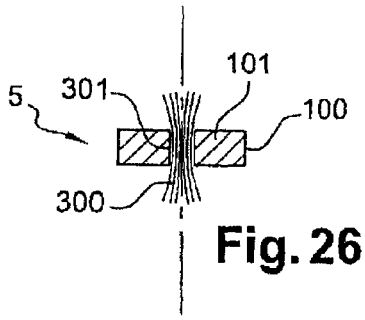
FIGS. 26 and 28 are cross-sections on XXVI-XXVI of FIG. 25 and XXVIII-XXVIII of FIG. 27.

As shown, and if so desired, the applicator member 5 may further include metal applicator elements 100, e.g. on the sides of the applicator member that are different from the faces via which the bristles exit. Each of the holes 301 receiving a tuft of bristles may be of axis that is perpendicular to a major axis of the flat cross-section of the metal portion of the applicator member, as shown in FIG. 26.

In a variant, the axis of the holes may be other, e.g. oblique relative to the major axis.

Figure 27:
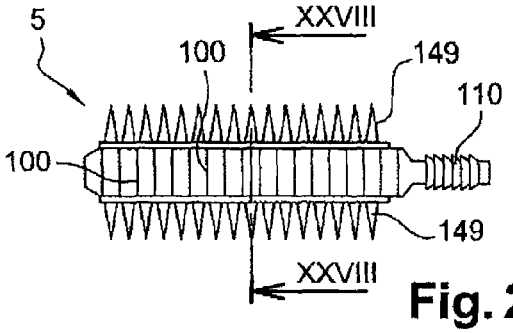
Figure 28:
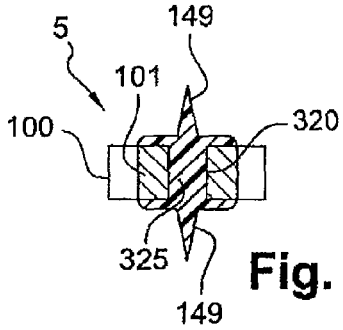

FIGS. 27 and 28 show an exemplary embodiment of making the applicator element 5 with a housing 320, e.g. in the form of a through hole or a through slot, the housing being filled with a non-metal material 325, e.g. a thermoplastic material that is molded onto the metal portion. The applicator elements 149 may be formed with the non-metal portion, molded on the metal portion. By way of example, the applicator elements 149 are in the form of teeth, e.g. disposed in rows on one or more sides of the applicator member.

Figure 31:
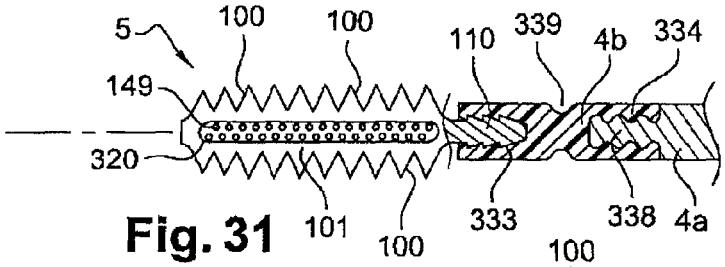
FIG. 31 is a fragmentary longitudinal section showing a variant of an applicator member.

FIG. 31 shows an applicator member in which the housing 320 is in the form of an elongate slot that is parallel to the longitudinal axis of the applicator member. On at least one side of the applicator member, at least one row of teeth 149 is made of thermoplastic material, e.g. with teeth disposed in a staggered configuration.

In this figure, it can also be seen that the flexible portion 4*b* of the stem may be made with two housings 333 and 334 at its axial ends, in which housings there are inserted respectively, the tang 110 of the metal portion of the applicator member and an endpiece 338 made with the rigid portion of the stem. By way of example, the endpiece 338 and the tang 110 are provided with portions in relief for improving anchoring within the flexible portion 4*b*. The flexible portion may be made with at least one groove 339, as shown, so as to impart more flexibility thereto.

When the applicator member 5 is made with at least one non-metal portion, the metal portion may include at least one channel 341 that may serve to inject, inside the metal portion of the applicator member, the thermoplastic material for constituting the non-metal portion.

Figure 32:
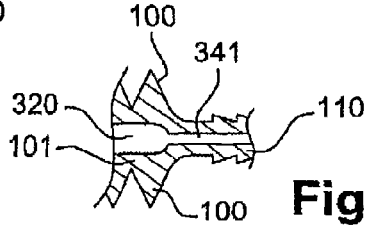
FIG. 32 is a longitudinal section showing an embodiment detail.

By way of example, the channel 341 may extend into the tang 110 of the metal portion of the applicator member, or may even pass right through it, and, as shown in FIG. 32, may open out into a housing 320 that is, for example, a slot extending longitudinally over the major fraction of the applicator member.

Figure 29:
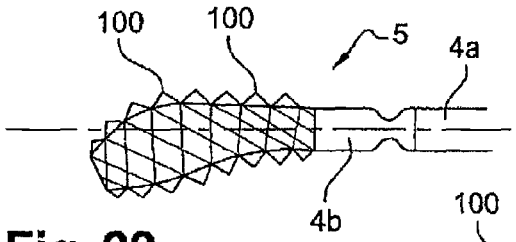
FIGS. 29 and 30 are fragmentary views showing stems provided with applicator members constituting variant embodiments of the invention.

FIG. 29 shows an exemplary embodiment of making the applicator member with an application portion that is off-center relative to the longitudinal axis of the stem.

Figure 30:
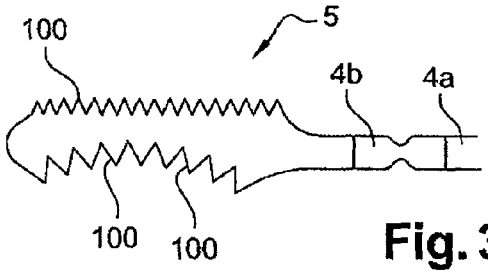

FIG. 30 shows an exemplary embodiment of making the applicator member with an application portion that presents two distinct sides in which the implantation of the projecting elements is different. For example, one of the sides may present projecting elements that are very close together, while the other side may present projecting elements that are spaced further apart from one another. The size of the projecting elements on each of the faces may be different. By way of example, the two sides are situated opposite each other.

Where appropriate, the applicator member may be associated with a heat source. The applicator member may then incorporate a heater element, e.g. a resistor wire.

In all of the embodiments described above, metal may be replaced by another inorganic material, e.g. a ceramic or a glass.

The expression "comprising a" should be understood as being synonymous with "comprising at least one" unless specified to the contrary.

What is claimed is:

1. An applicator comprising:

a rigid applicator member comprising an inorganic material, the applicator further member comprising a core that is different from a twisted core, and projecting applicator elements extending from the core; and a stem supporting the applicator member and comprising a rigid portion, and a flexible portion extending between the applicator member and the rigid portion, wherein the flexible portion is made, at least in part, of a material selected from one of the following: an elastomer material, a thermoplastic, a thermoplastic elastomer, low-density polyethylene (LDPE), polyvinyl chloride (PVC), polyurethane (PU), copolymers of esterified polytetramethylene or other thermoplastic elastomer polyesters, oxide glycol and butene terephthalate, ethylene-propylene-diene terpolymer (EPDM), propylene-diene terpolymer (PDM), ethyl vinyl acetate (EVA), styrene-isoprene-styrene (SIS), styrene-ethylene-butylene-styrene (SEBS), styrene-butadiene-styrene (SBS), latex, silicone rubber, nitrile rubber, butyl rubber, polyurethane, or polyether block amide.

2. An applicator according to claim 1, wherein the applicator elements are other than a helical spring.

3. An applicator according to claim 1, wherein the flexible portion comprises a synthetic material.

4. An applicator according to claim 1, further comprising a vibration source configured to vibrate the applicator member.

5. An applicator according to claim 1, wherein the flexible portion is in contact with the applicator member.

6. An applicator according to claim 1, wherein the applicator member consists of the inorganic material.

7. An applicator according to claim 6, wherein the applicator member is machined or molded.

8. An applicator according to claim 6, wherein the inorganic material is selected from metals, ceramics, or glasses.

9. An applicator according to claim 8, wherein the inorganic material is metal.

10. An applicator according to claim 1, wherein the weight of the applicator member is greater than 0.5 g.

11. An applicator according to claim 1, wherein the projecting applicator elements comprise a plurality of transverse ribs.

12. An applicator according to claim 11, wherein the projecting applicator elements comprise a plurality of annular ribs.

13. An applicator according to claim 4, wherein the vibration source comprises a component that is parallel to a longitudinal axis of the stem.

14. An applicator according to claim 1, wherein the flexible portion is molded in contact with the applicator member.

15. An applicator according to claim 1, wherein the applicator member has a longitudinal axis that is curvilinear.

16. An applicator according to claim 1, wherein the applicator member is subjected to a surface treatment or has a surface coating.

17. An applicator according to claim 1, wherein the applicator member is flocked, at least in part.

18. An applicator according to claim 1, wherein the applicator member is formed as a single part.

* * * * *